US009478337B2

(12) United States Patent
Kim et al.

(10) Patent No.: US 9,478,337 B2
(45) Date of Patent: Oct. 25, 2016

(54) MAGNET PLATE

(71) Applicant: Samsung Display Co., Ltd., Yongin-si, Gyeonggi-do (KR)

(72) Inventors: Do-Sun Kim, Busan (KR); Jeong Won Han, Seongnam-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 0 days.

(21) Appl. No.: 14/836,527

(22) Filed: Aug. 26, 2015

(65) Prior Publication Data

US 2016/0217895 A1 Jul. 28, 2016

(30) Foreign Application Priority Data

Jan. 22, 2015 (KR) ..... 10-2015-0010849

(51) Int. Cl.
*H01F 1/00* (2006.01)
*H01F 7/02* (2006.01)

(52) U.S. Cl.
CPC ..... *H01F 7/0247* (2013.01)

(58) Field of Classification Search
CPC ..... H01L 51/56; C23C 14/50
USPC ..... 335/219, 296
See application file for complete search history.

(56) References Cited

U.S. PATENT DOCUMENTS 6,888,621 B2 * 5/2005 Araki ..... G03B 27/42 355/53
8,361,230 B2 1/2013 Manz
8,686,819 B2 * 4/2014 Schuessler ..... G03F 1/14 335/289
9,048,460 B2 * 6/2015 Lee ..... H01L 51/52
2009/0291610 A1 * 11/2009 Sasaki ..... C23C 14/042 445/24
2010/0112194 A1 * 5/2010 Inoue ..... C23C 14/042 427/66
2011/0052791 A1 * 3/2011 Jo ..... C23C 14/042 427/8
2014/0291620 A1 * 10/2014 Choi ..... C23C 14/042 257/40

FOREIGN PATENT DOCUMENTS

JP 2014-088606 A 5/2014
KR 10-2003-0069679 A 8/2003
KR 10-2005-0035561 A 4/2005
KR 10-2008-0038650 A 5/2008
KR 10-2011-0080049 A 7/2011
KR 10-2011-0128579 A 11/2011
KR 10-2012-0092935 A 8/2012

* cited by examiner

*Primary Examiner* — Alexander Talpalatski
(74) *Attorney, Agent, or Firm* — Knobbe Martens Olson & Bear LLP

(57) ABSTRACT

A magnet plate for manufacturing a display device is disclosed. In one aspect, the plate includes at least two magnet units formed in a first direction, each magnet unit including first and second linear motion (LM) guides. The plate also includes a support plate attached to the LM guides. The magnet unit also includes a magnet supporter comprising an upper portion including a magnet coupling part, a lower portion including a plurality of cam followers, and at least two first transfer plate coupling protrusions formed at a predetermined interval. The magnet unit further includes a magnet guide plate placed beneath the magnet supporter and including a guide cam hole into which the cam follower is inserted. The guide cam hole is oblique with respect to the first direction and has a predetermined width such that the cam follower moves within the guide cam hole.

20 Claims, 9 Drawing Sheets

MAGNET PLATE

RELATED APPLICATIONS

This application claims priority to and the benefit of Korean Patent Application No. 10-2015-0010849 filed in the Korean Intellectual Property Office on Jan. 22, 2015, the entire contents of which are incorporated herein by reference.

BACKGROUND

1. Field

The described technology generally relates to a magnet plate.

2. Description of the Related Technology

An organic light-emitting diode (OLED) display does not have a separate light source (unlike the backlight in a liquid crystal display) and therefore, has a reduced thickness and weight.

In addition, OLED displays have favorable characteristics such as low power consumption, high luminance, high refresh rate, among others.

Generally, OLED displays include an organic layer which includes a substrate and emission layers patterned on the substrate for each pixel.

The organic layer is formed by using an organic layer deposition apparatus which includes a mask placed between a deposition source that evaporates organic material to be deposited on the substrate and the substrate on which the organic material is deposited.

When forming the organic layer as described above, to deposit the organic deposits in a desired area of the substrate, it is important to make the mask adhere to the substrate.

To make the mask adhere to the substrate, a magnet plate is provided facing the mask, having the substrate placed therebetween, in which the magnet plate pulls the mask by a magnetic force, and as a result, the mask adheres to the substrate.

Further, a magnetic field is uniformly formed only in the pulled mask, and thus, it suppresses the deformation of slits within the mask.

SUMMARY OF CERTAIN INVENTIVE ASPECTS

One inventive aspect relates to a position controllable magnet plate for performing a deposition process without replacing the magnet plate even when a mask is changed, by moving a magnet disposed on the magnet plate for each row.

Another aspect is a position controllable magnet plate, comprising: at least two controllable magnet units which are arranged in a row direction; and a support plate fixedly supporting the first LM guide and the second LM guide of the controllable magnet units which are arranged in a row, wherein the controllable magnet unit includes: a magnet support having an upper provided with a magnet coupling part, a lower portion provided with several cam followers and at least two first transfer plate coupling protrusions at a predetermined interval, and extending in a horizontal direction; a magnet guide plate disposed beneath the magnet supporter, provided with a guide cam hole which is inserted with the cam follower and has an oblique form and a predetermined width so that the cam follower moves and a connection hole which communicates with the first transfer plate coupling protrusion and has a predetermined width so that the first transfer plate coupling protrusion moves, and extending in a horizontal direction; a first transfer plate coupled with the first transfer plate coupling protrusion penetrating through the connection hole; a first LM guide coupled with a lower portion of the first transfer plate and formed to make the first transfer plate move in a thickness direction of the magnet guide plate; a second transfer plate coupled with a lower portion of the magnet guide plate; a second LM guide coupled with a lower portion of the second transfer plate and formed to make the second transfer plate move in a length direction of the magnet guide plate; and a moving device mounted at a distal end of the magnet guide plate and linearly moving the magnet guide plate.

The first LM guide can include an integrated first LM guide coupled with the first transfer plate of odd-numbered position controllable magnet units which are arranged in a row and an integrated first LM guide coupled with the first transfer plate of even-numbered position controllable magnet units which are arranged in a row.

The moving device can be a rack gear which is mounted at a distal end of the magnet guide plate and a worm gear contacting the rack gear.

The rack gear can be mounted on the upper portion or the lower portion of the magnet guide plate of the odd-numbered controllable magnet units which are arranged in a row and can be mounted on the lower portion or the upper portion of the magnet guide plate of the even-numbered controllable magnet units which are arranged in a row unlike the odd-numbered controllable magnet units, at the distal end of one side of the controllable magnet units which are arranged in a row.

The position controllable magnet plate can further include an actuator connected to the worm gear to apply a torque.

The position controllable magnet plate can further include a plurality of clutches connected to the worm gear and an actuator applying a torque to the plurality of clutches.

The position controllable magnet plate can further include a controller of the actuator or the clutch and can be automatically controlled by the controller.

Another aspect is a magnet plate for manufacturing a display device, comprising: at least two magnet units formed in a first direction, wherein each magnet unit includes first and second linear motion (LM) guides; and a support plate attached to the first and second LM guides. The magnet unit further includes: a magnet supporter comprising i) an upper portion including a magnet coupling part, ii) a lower portion including a plurality of cam followers, and iii) at least two first transfer plate coupling protrusions formed at a predetermined interval, wherein the magnet supporter extends in the first direction; a magnet guide plate placed beneath the magnet supporter and including i) a guide cam hole into which the cam follower is inserted, wherein the guide cam hole is oblique with respect to the first direction and has a predetermined width such that the cam follower moves within the guide cam hole, and ii) a connection hole configured to communicate with the first transfer plate coupling protrusion and has a predetermined width such that the first transfer plate coupling protrusion moves within the connection hole, wherein the magnet guide plate extends in the first direction; a first transfer plate connected to the first transfer plate coupling protrusion penetrating through the connection hole; the first LM guide connected to the first transfer plate and a lower portion of the first transfer plate, wherein the first transfer plate is configured to move along the first LM guide in a second direction crossing the first direction; a second transfer plate connected to a lower portion of the magnet guide plate; the second LM guide connected to the second transfer plate and a lower portion of the second transfer plate, wherein the second transfer plate is configured to move along the second LM guide in a third direction crossing the first and second directions; and a moving device mounted at a first end of the magnet guide plate and configured to linearly move the magnet guide plate.

In the above magnet plate, the at least two magnet units include a plurality of odd-numbered magnet units and a plurality of even-numbered magnet units, wherein the first LM guide includes i) a first integrated guide connected to the first transfer plate of at least one of the odd-numbered magnet units and ii) a second integrated guide connected to the first transfer plate of at least one of the even-numbered magnet units.

In the above magnet plate, the moving device includes a rack gear mounted at the first end of the magnet guide plate and a worm gear contacting the rack gear.

In the above magnet plate, the rack gear is mounted on i) the upper portion or the lower portion of the magnet guide plate of the odd-numbered magnet units and ii) the lower portion or the upper portion of the magnet guide plate of the even-numbered magnet units, wherein the upper and lower portions of the magnet guide plate of the odd-numbered magnet units respectively correspond to the lower and upper portions of the magnet guide plate of the even-numbered magnet units.

The above magnet plate further comprises an actuator connected to the worm gear so as to apply a predetermined amount of torque.

The above magnet plate further comprises: a plurality of clutches connected to the worm gear; and an actuator configured to apply a predetermined amount of torque to the clutches.

The above magnet plate further comprises a controller configured to control at least one of the actuator and the clutches.

Another aspect is a magnet plate for manufacturing a display device, comprising: at least two magnet units formed in a first direction and including first and second linear motion (LM) guides. Each magnet unit includes: a magnet supporter comprising i) an upper portion including a magnet coupling part, ii) a lower portion including a plurality of cam followers, and iii) at least two first transfer plate coupling protrusions formed at a predetermined interval, wherein the magnet supporter extends in the first direction; a magnet guide plate placed beneath the magnet supporter and including i) a guide cam hole into which the cam follower is inserted, wherein the guide cam hole is oblique with respect to the first direction and has a predetermined width such that the cam follower moves within the guide cam hole, and ii) a connection hole configured to communicate with the first transfer plate coupling protrusion and has a predetermined width such that the first transfer plate coupling protrusion moves within the connection hole, wherein the magnet guide plate extends in the first direction; a first transfer plate connected to the first transfer plate coupling protrusion penetrating through the connection hole; the first LM guide connected to the first transfer plate and a lower portion of the first transfer plate, wherein the first transfer plate is configured to move along the first LM guide in a second direction crossing the first direction; a second transfer plate connected to a lower portion of the magnet guide plate; the second LM guide connected to the second transfer plate and a lower portion of the second transfer plate, wherein the second transfer plate is configured to move along the second LM guide in a third direction crossing the first and second directions; and a moving device mounted at a first end of the magnet guide plate and configured to linearly move the magnet guide plate.

In the above magnet plate, the at least two magnet units include a plurality of odd-numbered magnet units and a plurality of even-numbered magnet units, wherein the first LM guide includes i) a first integrated guide connected to the first transfer plate of at least one of the odd-numbered magnet units and ii) a second integrated guide connected to the first transfer plate of at least one of the even-numbered magnet units.

In the above magnet plate, the moving device includes a rack gear mounted at the first end of the magnet guide plate and a worm gear contacting the rack gear.

In the above magnet plate, the rack gear is mounted on i) the upper portion or the lower portion of the magnet guide plate of the odd-numbered magnet units and ii) the lower portion or the upper portion of the magnet guide plate of the even-numbered magnet units, wherein the upper and lower portions of the magnet guide plate of the odd-numbered magnet units respectively correspond to the lower and upper portions of the magnet guide plate of the even-numbered magnet units.

The above magnet plate further comprises an actuator connected to the worm gear so as to apply a predetermined amount of torque.

The above magnet plate further comprises: a plurality of clutches connected to the worm gear; and an actuator configured to apply a predetermined amount of torque to the clutches.

The above magnet plate further comprises a controller configured to control at least one of the actuator and the clutches.

Another aspect is a magnet plate for manufacturing a display device, comprising: at least two magnet units formed in a first direction. Each magnet unit includes: a magnet supporter comprising i) an upper portion including a magnet coupling part, ii) a lower portion including a plurality of cam followers, and iii) at least two first transfer plate coupling protrusions formed at a predetermined interval, wherein the magnet supporter extends in the first direction; a magnet guide plate placed beneath the magnet supporter and including i) a guide cam hole into which the cam follower is inserted, wherein the guide cam hole is oblique with respect to the first direction and has a predetermined width such that the cam follower moves within the guide cam hole and ii) a connection hole configured to communicate with the first transfer plate coupling protrusion and has a predetermined width such that the first transfer plate coupling protrusion moves within the connection hole, wherein the magnet guide plate extends in the first direction; a first transfer plate connected to the first transfer plate coupling protrusion penetrating through the connection hole; a first LM guide connected to the first transfer plate and a lower portion of the first transfer plate, wherein the first transfer plate is configured to move along the first LM guide in a second direction crossing the first direction; and a moving device mounted at a first end of the magnet guide plate and configured to linearly move the magnet guide plate.

In the above magnet plate, the at least two magnet units include a plurality of odd-numbered magnet units and a plurality of even-numbered magnet units, wherein the first LM guide includes i) a first integrated guide connected to the first transfer plate of at least one of the odd-numbered magnet units and ii) a second integrated guide connected to the first transfer plate of at least one of the even-numbered magnet units.

In the above magnet plate, the moving device includes a rack gear mounted at the first end of the magnet guide plate and a worm gear contacting the rack gear.

In the above magnet plate, the rack gear is mounted on i) the upper portion or the lower portion of the magnet guide plate of the odd-numbered magnet units and ii) the lower portion or the upper portion of the magnet guide plate of the even-numbered magnet units, wherein the upper and lower portions of the magnet guide plate of the odd-numbered magnet units respectively correspond to the lower and upper portions of the magnet guide plate of the even-numbered magnet units.

The above magnet plate further comprises: a plurality of clutches connected to the worm gear; and an actuator configured to apply a predetermined amount of torque to the clutches.

The above magnet plate further comprises a controller configured to control at least one of the actuator and the clutches.

According to at least one of the disclosed embodiments, the operation of replacing the magnet plate can be omitted, there is no need to manufacture the magnet plates for each model to be deposited, the process of destructing the vacuum of the chamber or again making the chamber the vacuum state due to the replacement of the magnet plate can be omitted, thereby preventing the time consumption, improving the productivity, and reducing the deposition costs.

DETAILED DESCRIPTION OF CERTAIN INVENTIVE EMBODIMENTS

Figure 1:
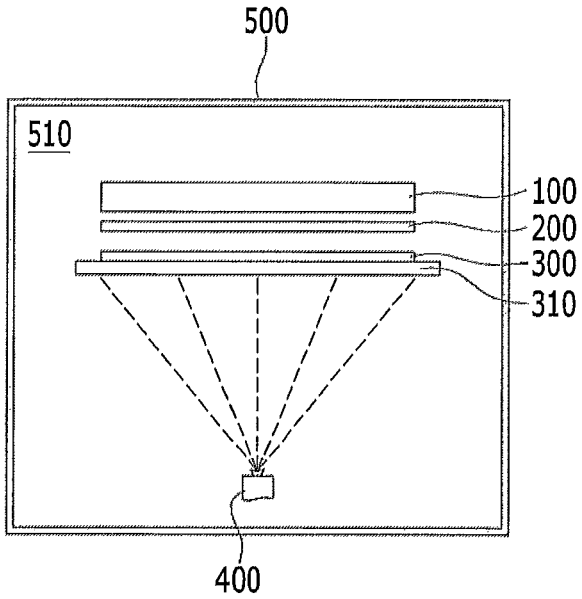
FIG. 1 is a schematic diagram illustrating a deposition apparatus.

When a model or pattern is changed, the corresponding mask is changed. A magnetic field applied on the changed mask is non-uniform and the position and the shape of the slit within the mask also change. Thus, the resultant thin film deposition pattern may not have the desired position and/or shape.

To prevent this, there is a need to replace the magnet plate corresponding to the mask whenever the model is changed. The operation of replacing the magnet plate includes separating the magnet plate and various structures and reassembling them, and the time expended is a loss in productivity.

Further, the magnet plate needs to be individually manufactured for each model, and therefore, deposition costs can rise. Also, the deposition process needs to be performed inside a chamber to maintain a vacuum state, and therefore, in the case of replacing the magnet plate, the vacuum of the chamber needs to be disassembled. As a result, it takes time to reassemble the chamber a vacuum state and stabilize the deposition rate.

Hereinafter, the described technology will be described more fully hereinafter with reference to the accompanying drawings, in which exemplary embodiments are shown. As those skilled in the art would realize, the described embodiments can be modified in various different ways, all without departing from the spirit or scope of the described technology.

It is to be noted that the accompanying drawings is schematically illustrated and is not illustrated to a scale. A relative dimension and ratio of components are illustrated being exaggerated or reduced in the drawings for clarity and convenience in the drawings and any dimension is only an example and therefore is not limited thereto. Further, the same structures, elements, or parts which are illustrated in at least two drawings are denoted by the same reference numerals, which is used to indicate similar features. The mention that any portion is present "over" or "on" another portion device that any portion can be directly formed on another portion or a third portion can be interposed between one portion and another portion.

An exemplary embodiment will be described in detail. As the result, numerous variations of exemplary embodiments are expected. Therefore, the exemplary embodiments are not limited to a specific form of the illustrated region and, for example, also include a form changed by manufacturing.

Hereinafter, a position controllable magnet plate according to an exemplary embodiment will be described in detail with reference to FIG. 1. In this disclosure, the term "substantially" includes the meanings of completely, almost completely or to any significant degree under some applications and in accordance with those skilled in the art.

FIG. 1 is a schematic diagram illustrating a deposition apparatus.

As illustrated in FIG. 1, a deposition apparatus includes a chamber 500 which is operated at a predetermined temperature, in which any one end of an upper portion or a lower portion in the chamber 500 is provided with a deposition source 400 in which organic deposits are accommodated. An opposite side of the deposition source 400 is provided with a substrate 200, having an assembly of a mask 300 and a frame 310 interposed therebetween.

A position controllable magnet plate 100 according to an exemplary embodiment is provided to face the assembly of the mask 300 and the frame 310, having the substrate placed therebetween. The position controllable magnet plate 100 pulls the mask 300 by a magnetic force to make the mask 300 adhere to the substrate 200.

In depositing the organic deposits on the substrate 200 by the deposition apparatus, after an inner space 510 of the chamber 500 is maintained in a vacuum state having a predetermined vacuum degree and is maintained at a predetermined temperature greater than a room temperature, the organic deposits are evaporated or sublimated from the deposition source 400 to be deposited on the substrate 200 through the mask 300.

Generally, the magnet plate uniformly forms a magnetic field on the mask to suppress a deformation of a slit within the mask. However, generally even when the mask 300 is changed according to a change in a deposited model (or deposited pattern), and the like, the position controllable magnet plate 100 according to the exemplary embodiment can substantially uniformly form the applied magnetic field in response to the changed mask.

This can be implemented by making the magnet supporter 120 vertically move on upper portions of the controllable magnet units 110 which are arranged in a row.

Hereinafter, this will be described in detail.

Figure 2:
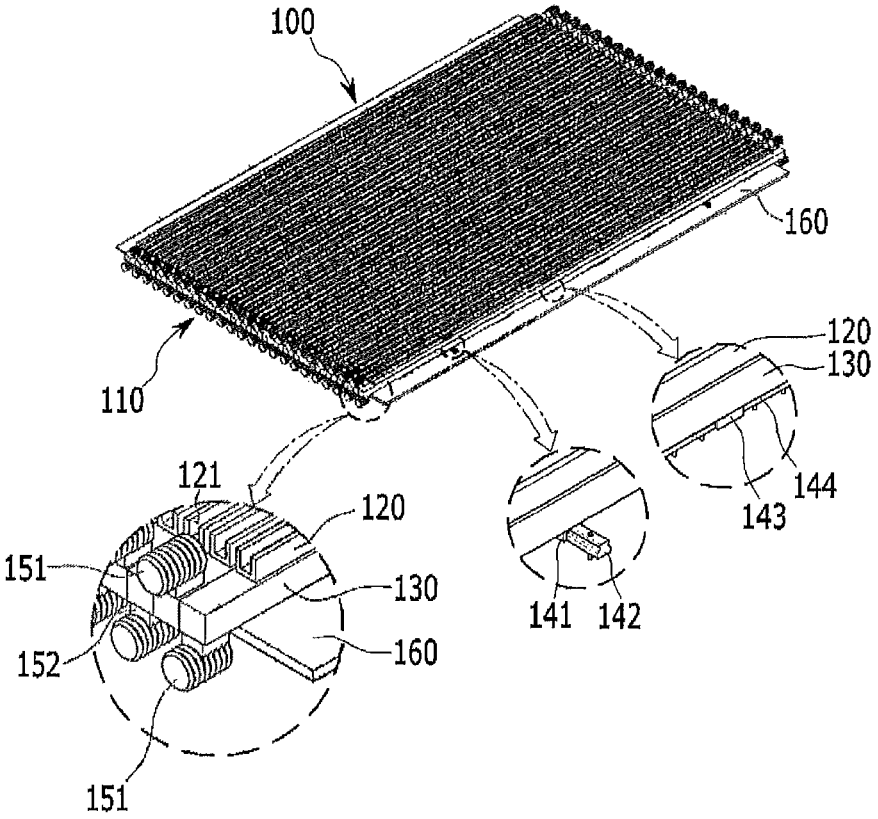
FIG. 2 is a perspective view of a position controllable magnet plate according to an exemplary embodiment.

FIG. 2 is a perspective view of a position controllable magnet plate according to an exemplary embodiment.

As illustrated in FIG. 2, the position controllable magnet plate 100 according to the exemplary embodiment includes a plurality of controllable magnet units 110 which are arranged in a row, and a support plate 160.

The controllable magnet units 110 are fixed to the support plate 160 by first and second linear motion (LM) guides 142 and 144 and first and second transfer plates 141 and 143 which are components thereof.

The controllable magnet unit 110 can include a worm gear 151 and a rack gear 152 which are a moving device 150, in which the worm gear 151 and the rack gear 152 can be provided on the upper portion or the lower portion of the controllable magnet units 110 which are arranged in a row. The worm gear 151 and the rack gear 152 can intersect each other and these gears 151 and 152 will be described in detail with reference to FIG. 4.

Figure 3:
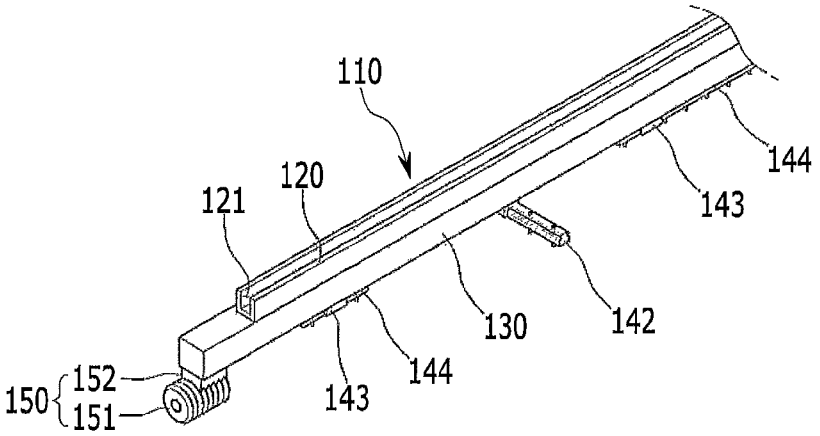
FIG. 3 is a perspective view of a controllable magnet unit according to an exemplary embodiment.
Figure 4:
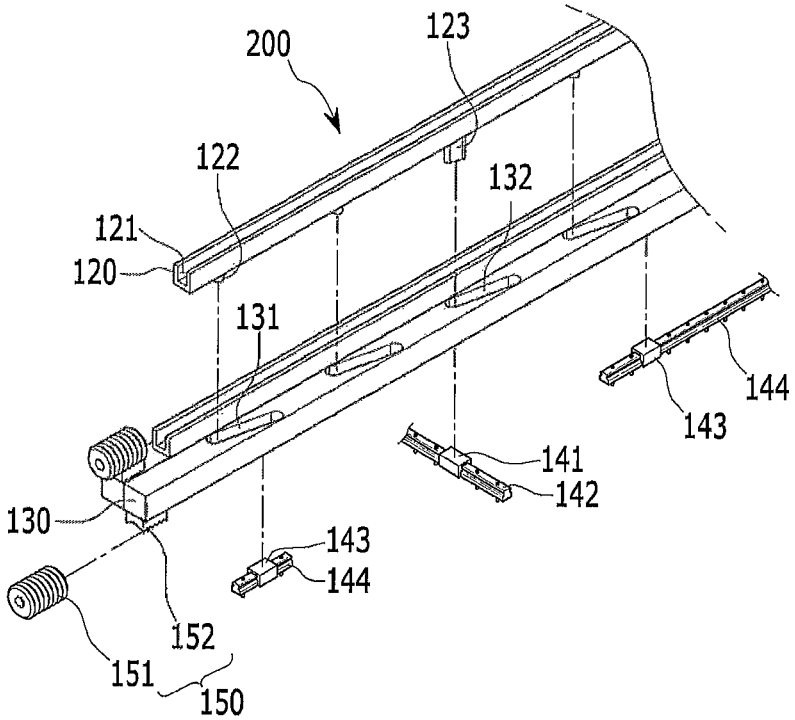
FIG. 4 is an exploded perspective view of the controllable magnet unit according to the exemplary embodiment.

FIG. 3 is a perspective view of a controllable magnet unit according to an exemplary embodiment. FIG. 4 is an exploded perspective view of the controllable magnet unit according to the exemplary embodiment.

The controllable magnet unit 110 according to the exemplary embodiment includes a magnet supporter 120, a magnet guide plate 130, an assembly of the first transfer plate 141 and the first LM guide 142, an assembly of the second transfer plate 143 and the second LM guide 144, and the moving device 150.

The magnet supporter 120 extends in a horizontal direction and an upper portion of the magnet supporter 120 is provided with predetermined grooves. The grooves form a magnet coupling part (or magnetic coupling portion) 121, in which the magnet coupling part 121 is coupled to a magnet (not illustrated).

A lower portion of the magnet supporter 120 is provided with several cam followers 122 which are inserted into guide cam holes 131 of the magnet guide plate 130.

Further, the lower portion of the magnet supporter 120 is provided with at least two first transfer plate coupling protrusions 123 at a predetermined interval. The first transfer plate coupling protrusions 123 are coupled to the first transfer plate 141.

The lower portion of the magnet supporter 120 is provided with the magnet guide plate 130.

The magnet guide plate 130 is provided with the guide cam hole 131 into which the cam follower 122 is inserted.

The guide cam hole 131 has a predetermined width and is oblique with respect to a thickness direction of the magnet guide plate 130.

The magnet guide plate 130 is provided with a connection hole 132 with which the first transfer plate coupling protrusion 123 of the magnet supporter 120 communicates.

The connection hole 132 has a width large enough to move the first transfer plate coupling protrusion 123 freely in the guide cam hole 131 of the cam follower 122.

The lower portion of the magnet guide plate 130 is provided with the first transfer plate 141 which is coupled to the first transfer plate coupling protrusion 123 penetrating through the connection hole 132.

Further, the lower portion of the first transfer plate 141 is coupled to the first LM guide 142 which is formed to enable the first transfer plate 141 to move in the thickness direction of the magnet guide plate 130.

The lower portion of the magnet guide plate 130 is coupled to the second transfer plate 143.

Further, the lower portion of the second transfer plate 143 is coupled to the second LM guide 144 which is formed to enable the second transfer plate 143 to move in a length direction of the magnet guide plate 130.

A distal end of the magnet guide plate 130 is provided with the moving device 150 by which the magnet guide plate 130 linearly moves in the length direction of the magnet guide plate 130.

The moving device 150 can include the worm gear 151 and the rack gear 152.

The rack gear 152 is coupled to the distal end of the magnet guide plate 130 and an opposite side of the coupled portion is formed with threads.

The worm gear 151 which is formed with threads corresponding to the threads of the rack gear 151 is disposed to contact the rack gear 152.

Meanwhile, the rack gear 152 can be mounted on the upper portion or the lower portion of the magnet guide plate 130.

When a diameter of the worm gear 151 is formed to be large, a contact area of the worm gear 151 and the rack gear 152 is greater than when the diameter of the worm gear 151 is formed to be small to increase a friction force between the worm gear 151 and the rack gear 152. Therefore the diameter of the worm gear 151 can be formed to be as large as a predetermined numerical value.

Meanwhile, when the diameter of the worm gear 151 is formed to be large as described above, the diameter of the worm gear 151 is larger than a numerical value of the thickness of the magnet guide plate 130. Therefore the problem of the controllable magnet units 110 not being arranged in a row while contacting each other can occur. As a result, the rack gear 152 of one side of the controllable magnet units 110 which are arranged in a row, while being adjacent to each other, can be mounted on the magnet guide plate 130, and the rack gear 152 of the other side of the controllable magnet units 110 can be mounted beneath the magnet guide plate 130.

Hereinafter, an operation structure of the magnet supporter 120 of the position controllable magnet plate 100 will be described in detail.

Figure 5:
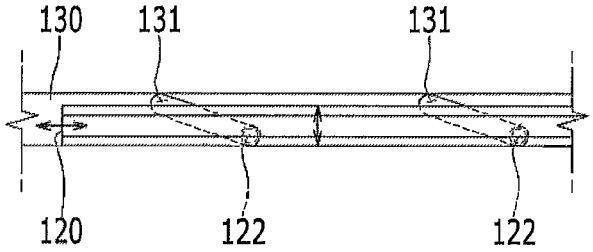
FIG. 5 is a plan view of an operation structure of a magnet supporter according to an exemplary embodiment.

FIG. 5 is a plan view of an operation structure of a magnet supporter according to an exemplary embodiment.

As illustrated in FIG. 5, the cam hole follower 122 of the magnet supporter 120 is inserted into the guide cam hole 131 of the magnet guide plate 130. Therefore, when the magnet supporter 120 can move only in a vertical direction and the magnet guide plate 130 can move only in a horizontal direction, the magnet supporter 120 moves in a vertical direction based on the horizontal movement of the magnet guide plate 130.

Figure 6:
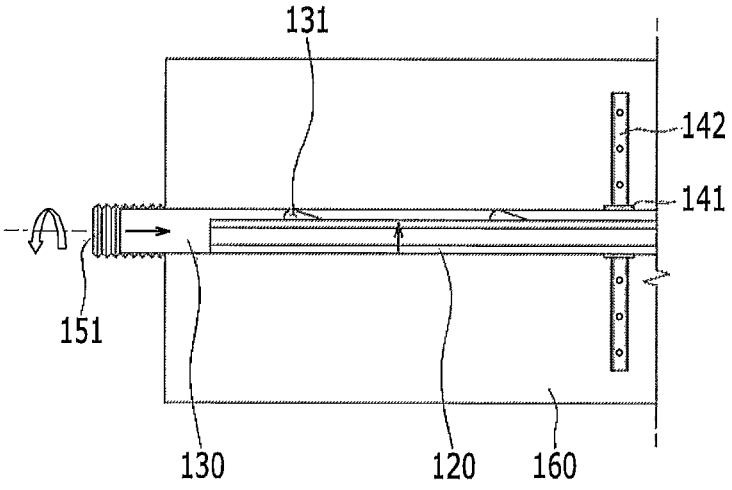
FIG. 6 is a plan view illustrating an appearance in which one controllable magnet unit according to an exemplary embodiment is coupled to a support plate.

FIG. 6 is a plan view illustrating an appearance in which one controllable magnet unit according to an exemplary embodiment is coupled to a support plate.

First, the magnet supporter 120 is coupled to the assembly of the first transfer plate 141 and the first LM guide 142 by the first transfer plate coupling protrusion 123 and the first LM guide 142 is fixedly supported to the support plate 160.

By this configuration, the magnet supporter 120 can move only in the thickness direction of the magnet guide plate 130, that is, only in the vertical direction in FIG. 6.

Next, the magnet guide plate 130 is coupled to the assembly of the second transfer plate 143 and the second LM guide 144. The second LM guide 142 is fixed to the support plate 160.

By this configuration, the magnet guide plate 130 can move in the length direction of the magnet guide plate 130, that is, only in the horizontal direction in FIG. 6.

In the state as described above, as illustrated in FIG. 6, when the worm gear 151 rotates counterclockwise, the magnet guide plate 130 moves in a right direction based on the rack gear 152 which is mounted at the distal end of the magnet guide plate 130, Thus, the magnet supporter 120 moves upwardly.

When the worm gear 151 rotates clockwise, the magnet guide plate 130 moves in a left direction, and thus the magnet supporter 120 moves downward.

That is, the magnet supporter 120 can move vertically and the magnet coupled to the magnet supporter 120 can also move vertically.

Figure 7:
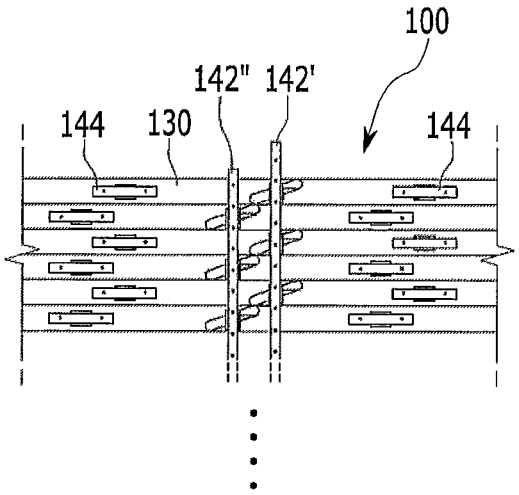
FIG. 7 is a rear view of a row arrangement state of the controllable magnet unit according to an exemplary embodiment.

FIG. 7 is a rear view of a row arrangement state of the controllable magnet unit according to the exemplary embodiment, in which the support plate 150 is not illustrated.

As illustrated in FIG. 7, the first LM guide 142 includes an integrated first LM guide (or first integrated guide) 142' which is coupled to the first transfer plate 141 of odd-numbered position controllable magnet units 110 which are arranged in a row and an integrated first LM guide (or second integrated guide) 142" which is coupled to the first transfer plate 141 of even-numbered position controllable magnet units 110 which are arranged in a row.

Figure 8:
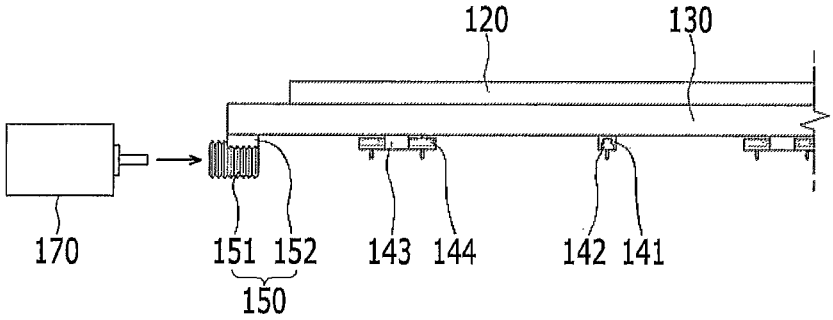
FIG. 8 is a side view illustrating a moving device of the position controllable magnet plate according to an exemplary embodiment.
Figure 9:
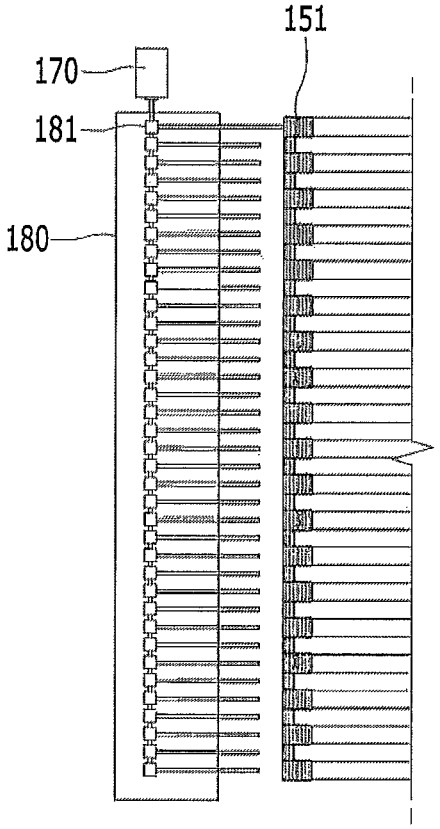
FIG. 9 is a schematic plan view illustrating a moving device of a position controllable magnet plate according to an exemplary embodiment.

FIG. 8 is a side view illustrating a moving device of the position controllable magnet plate according to an exemplary embodiment. FIG. 9 is a schematic plan view illustrating a moving device of a position controllable magnet plate according to another exemplary embodiment.

First, as illustrated in FIG. 8, individual controllable magnet units 110 are automatically operated by an actuator 170 which is connected to the worm gear 151 to apply a torque.

The actuator 170 which can apply enough torque and can be implemented by a general device, and therefore a description thereof will be omitted.

In addition, it is possible to manually rotate the worm gear 151 using a driver, a hexagonal wrench, or the like.

Next, as illustrated in FIG. 9, the moving device includes a gear box 180 provided with a plurality of clutches 181 which are connected to the individual worm gears 151 and the actuator 170 which applies rotary power to the clutches 181. The clutch 181 transfers the torque of the actuator 170 to the worm gear 151 to automatically operate the individual controllable magnet units 110.

Further, the position controllable magnet plate 100 includes a controller which automatically controls the actuator 170 or the clutch 181, and the operation of the position controllable magnet unit 110 can be automatically controlled by the controller.

While the inventive technology has been described in connection with what is presently considered to be practical exemplary embodiments, it is to be understood that the inventive technology is not limited to the disclosed embodiments, but, on the contrary, is intended to cover various modifications and equivalent arrangements included within the spirit and scope of the appended claims.

What is claimed is:

1. A magnet plate for manufacturing a display device, comprising:

at least two magnet units formed in a first direction, wherein each magnet unit includes first and second linear motion (LM) guides; and a support plate attached to the first and second LM guides, wherein the magnet unit further includes:

a magnet supporter comprising i) an upper portion including a magnet coupling part, ii) a lower portion including a plurality of cam followers, and iii) at least two first transfer plate coupling protrusions formed at a predetermined interval, wherein the magnet supporter extends in the first direction;

a magnet guide plate placed beneath the magnet supporter and including i) a guide cam hole into which the cam follower is inserted, wherein the guide cam hole is oblique with respect to the first direction and has a predetermined width such that the cam follower moves within the guide cam hole, and ii) a connection hole configured to communicate with the first transfer plate coupling protrusion and has a predetermined width such that the first transfer plate coupling protrusion moves within the connection hole, wherein the magnet guide plate extends in the first direction;

a first transfer plate connected to the first transfer plate coupling protrusion penetrating through the connection hole;

the first LM guide connected to the first transfer plate and a lower portion of the first transfer plate, wherein the first transfer plate is configured to move along the first LM guide in a second direction crossing the first direction;

a second transfer plate connected to a lower portion of the magnet guide plate;

the second LM guide connected to the second transfer plate and a lower portion of the second transfer plate, wherein the second transfer plate is configured to move along the second LM guide in a third direction crossing the first and second directions; and a moving device mounted at a first end of the magnet guide plate and configured to linearly move the magnet guide plate.

2. The magnet plate of claim 1, wherein the at least two magnet units include a plurality of odd-numbered magnet units and a plurality of even-numbered magnet units, and wherein the first LM guide includes i) a first integrated guide connected to the first transfer plate of at least one of the odd-numbered magnet units and ii) a second integrated guide connected to the first transfer plate of at least one of the even-numbered magnet units.

3. The magnet plate of claim 1, wherein the moving device includes a rack gear mounted at the first end of the magnet guide plate and a worm gear contacting the rack gear.

4. The magnet plate of claim 3, wherein the rack gear is mounted on i) the upper portion or the lower portion of the magnet guide plate of the odd-numbered magnet units and ii) the lower portion or the upper portion of the magnet guide plate of the even-numbered magnet units, and wherein the upper and lower portions of the magnet guide plate of the odd-numbered magnet units respectively correspond to the lower and upper portions of the magnet guide plate of the even-numbered magnet units.

5. The magnet plate of claim 3, further comprising an actuator connected to the worm gear so as to apply a predetermined amount of torque.

6. The magnet plate of claim 3, further comprising:

a plurality of clutches connected to the worm gear; and an actuator configured to apply a predetermined amount of torque to the clutches.

7. The magnet plate of claim 6, further comprising a controller configured to control at least one of the actuator and the clutches.

8. A magnet plate for manufacturing a display device, comprising:

at least two magnet units formed in a first direction and including first and second linear motion (LM) guides, wherein each magnet unit includes:

a magnet supporter comprising i) an upper portion including a magnet coupling part, ii) a lower portion including a plurality of cam followers, and iii) at least two first transfer plate coupling protrusions formed at a predetermined interval, wherein the magnet supporter extends in the first direction;

a magnet guide plate placed beneath the magnet supporter and including i) a guide cam hole into which the cam follower is inserted, wherein the guide cam hole is oblique with respect to the first direction and has a predetermined width such that the cam follower moves within the guide cam hole, and ii) a connection hole configured to communicate with the first transfer plate coupling protrusion and has a predetermined width such that the first transfer plate coupling protrusion moves within the connection hole, wherein the magnet guide plate extends in the first direction;

a first transfer plate connected to the first transfer plate coupling protrusion penetrating through the connection hole;

the first LM guide connected to the first transfer plate and a lower portion of the first transfer plate, wherein the first transfer plate is configured to move along the first LM guide in a second direction crossing the first direction;

a second transfer plate connected to a lower portion of the magnet guide plate;

the second LM guide connected to the second transfer plate and a lower portion of the second transfer plate, wherein the second transfer plate is configured to move along the second LM guide in a third direction crossing the first and second directions; and a moving device mounted at a first end of the magnet guide plate and configured to linearly move the magnet guide plate.

9. The magnet plate of claim 8, wherein the at least two magnet units include a plurality of odd-numbered magnet units and a plurality of even-numbered magnet units, and wherein the first LM guide includes i) a first integrated guide connected to the first transfer plate of at least one of the odd-numbered magnet units and ii) a second integrated guide connected to the first transfer plate of at least one of the even-numbered magnet units.

10. The magnet plate of claim 8, wherein the moving device includes a rack gear mounted at the first end of the magnet guide plate and a worm gear contacting the rack gear.

11. The magnet plate of claim 10, wherein the rack gear is mounted on i) the upper portion or the lower portion of the magnet guide plate of the odd-numbered magnet units and ii) the lower portion or the upper portion of the magnet guide plate of the even-numbered magnet units, and wherein the upper and lower portions of the magnet guide plate of the odd-numbered magnet units respectively correspond to the lower and upper portions of the magnet guide plate of the even-numbered magnet units.

12. The magnet plate of claim 10, further comprising an actuator connected to the worm gear so as to apply a predetermined amount of torque.

13. The magnet plate of claim 10, further comprising:

a plurality of clutches connected to the worm gear; and an actuator configured to apply a predetermined amount of torque to the clutches.

14. The magnet plate of claim 13, further comprising a controller configured to control at least one of the actuator and the clutches.

15. A magnet plate for manufacturing a display device, comprising:

at least two magnet units formed in a first direction, wherein each magnet unit includes:

a magnet supporter comprising i) an upper portion including a magnet coupling part, ii) a lower portion including a plurality of cam followers, and iii) at least two first transfer plate coupling protrusions formed at a predetermined interval, wherein the magnet supporter extends in the first direction;

a magnet guide plate placed beneath the magnet supporter and including i) a guide cam hole into which the cam follower is inserted, wherein the guide cam hole is oblique with respect to the first direction and has a predetermined width such that the cam follower moves within the guide cam hole and ii) a connection hole configured to communicate with the first transfer plate coupling protrusion and has a predetermined width such that the first transfer plate coupling protrusion moves within the connection hole, wherein the magnet guide plate extends in the first direction;

a first transfer plate connected to the first transfer plate coupling protrusion penetrating through the connection hole;

a first LM guide connected to the first transfer plate and a lower portion of the first transfer plate, wherein the first transfer plate is configured to move along the first LM guide in a second direction crossing the first direction; and a moving device mounted at a first end of the magnet guide plate and configured to linearly move the magnet guide plate.

16. The magnet plate of claim 15, wherein the at least two magnet units include a plurality of odd-numbered magnet units and a plurality of even-numbered magnet units, and wherein the first LM guide includes i) a first integrated guide connected to the first transfer plate of at least one of the odd-numbered magnet units and ii) a second integrated guide connected to the first transfer plate of at least one of the even-numbered magnet units.

17. The magnet plate of claim 15, wherein the moving device includes a rack gear mounted at the first end of the magnet guide plate and a worm gear contacting the rack gear.

18. The magnet plate of claim 17, wherein the rack gear is mounted on i) the upper portion or the lower portion of the magnet guide plate of the odd-numbered magnet units and ii) the lower portion or the upper portion of the magnet guide plate of the even-numbered magnet units, and wherein the upper and lower portions of the magnet guide plate of the odd-numbered magnet units respectively correspond to the lower and upper portions of the magnet guide plate of the even-numbered magnet units.

19. The magnet plate of claim 17, further comprising:

a plurality of clutches connected to the worm gear; and an actuator configured to apply a predetermined amount of torque to the clutches.

20. The magnet plate of claim 19, further comprising a controller configured to control at least one of the actuator and the clutches.

* * * * *